United States Patent [19]

Belthle

[11] Patent Number: 4,696,130

[45] Date of Patent: Sep. 29, 1987

[54] METHOD OF PROFILING AND DRESSING GRINDING WHEELS

[75] Inventor: Heinz Belthle, Aichwald, Fed. Rep. of Germany

[73] Assignee: Schaudt Maschinenbau GmbH, Stuttgart, Fed. Rep. of Germany

[21] Appl. No.: 901,774

[22] Filed: Aug. 28, 1986

[30] Foreign Application Priority Data

Aug. 30, 1985 [DE] Fed. Rep. of Germany ..... 3531044

[51] Int. Cl.[4] ..... B24D 18/00

[52] U.S. Cl. ..... 51/293

[58] Field of Search ..... 51/293

[56] References Cited

U.S. PATENT DOCUMENTS

| | | | |
|---|---|---|---|
| 3,424,566 | 1/1969 | Kuenstle et al. | 51/293 |
| 3,756,796 | 9/1973 | Miller | 51/293 |
| 4,020,820 | 5/1977 | Kish | 51/293 |
| 4,285,171 | 8/1981 | Block et al. | 51/293 |
| 4,490,158 | 12/1984 | Kuromatsu | 51/293 |

*Primary Examiner*—Paul Lieberman

*Assistant Examiner*—Willie J. Thompson

*Attorney, Agent, or Firm*—Peter K. Kontler

[57] ABSTRACT

A profiling and dressing tool for grinding wheels which are used for the cutting of external threads has a diamond roll with a first circumferentially extending rib at one axial end and a second circumferentially extending rib at the other axial end. One of the ribs is used for preliminary profiling of the grinding wheel, and the other rib is used for final profiling and dressing. The tool can be used for the profiling and dressing of a wide range of grinding wheels having different diameters and grooves of different depths. One of the ribs is idle when the other rib is in use, and vice versa. If the grinding wheel is to be formed with a series of grooves alternating with ribs, each of the selected ribs of the diamond roll is moved radially of and toward the periphery of the grinding wheel, is thereupon extracted, moved axially of the grinding wheel, caused to plunge again into the material of the grinding wheel, and so forth until the profiling is completed. Such profiling is followed by a final profiling or dressing.

2 Claims, 5 Drawing Figures

METHOD OF PROFILING AND DRESSING GRINDING WHEELS

BACKGROUND OF THE INVENTION

The invention relates to improvements in methods of profiling and dressing grinding wheels, particularly grinding wheels for the cutting of external threads. The invention further relates to a grinding wheel which is profiled in accordance with the method and to improvements in tools which can be used to practice the method.

It is known to profile and dress grinding wheels for the cutting of external threads (so-called external thread grinders) with rotary diamond profile rolls each of which is provided with several alternating ribs and grooves defining a profile which is complementary to the desired profile or contour of the grinding wheel. It is also known to perform such profiling work with so-called multiple-groove crush dressing rolls. This renders it necessary to keep in stock a discrete profiling diamond roll for each and every size of the external thread, for example, for each of a full spectrum of external metric threads.

Conventional diamond form rolls or discs are provided with a single rib and are path controlled to thus achieve the desired profiling. The flexible path controlled dressing with diamond form rolls is more expensive because of the complexity of controls and the achieved peak-to-valley depth (effective surface finish) is less satisfactory than when operating with a diamond profile roll.

OBJECTS AND SUMMARY OF THE INVENTION

It is an object of the invention to provide a novel and improved tool for profiling and dressing thread grinders in such a way that the advantages of dressing with a diamond contour roll are combined with the advantages of path control dressing with diamond form rolls.

Another object of the invention is to provide a novel and improved method of profiling and dressing a grinding tool which is used to cut external threads.

A further object of the invention is to provide a novel and improved grinding wheel for the cutting of external threads.

One feature of the invention resides in the provision of a tool for profiling and dressing a grinding wheel for the making of external threads. The tool comprises a diamond roll having a first profiling rib for preliminary or coarse profiling, and a second profiling rib for final profiling and dressing of the grinding wheel. The first and second ribs are preferably disposed at the two end faces of the roll. The peripheral surface of the roll has two cylindrical portions which are adjacent the two ribs. The arrangement is preferably such that each rib is disposed between one of the cylindrical portions of the peripheral surface and the corresponding end face of the roll. The cylindrical portions have predetermined diameters which can be monitored as reference diameters, for example, to ascertain whether or not the roll is running out of true.

The roll can be provided with a coaxial socket which is bounded by a relatively short conical surface serving to engage a complementary conical surface on a torque transmitting component, such as a driven spindle.

Another feature of the invention resides in the a method of profiling and dressing a grinding wheel of the grinding of external threads with a diamond roll having a profiling rib. The method comprises the step of using the rib of the diamond roll to provide the periphery of the wheel with a first groove, withdrawing the rib from the first groove, moving the roll in parallelism with the (Z) axis of the wheel, and using the rib to provide the periphery of the wheel with a second groove. The same sequence of steps can be repeated again and again, depending on the number of grooves which are to be provided in the grinding wheel. Each of the using steps can include a first stage of preliminary profiling and a second stage of final profiling and, if necessary, dressing of the respective portion of the grinding wheel.

A further feature of the invention resides in the provision of a grinding wheel for external thread grinding. The improved grinding wheel comprises a plurality of ribs at a mutual spacing which is a multiple of that between the convolutions of the external thread which is to be ground by using the wheel.

An additional feature of the invention resides in the provision of a tool for profiling and/or dressing a grinding wheel for the making of external threads. The tool comprises a diamond roll having a single circumferentially extending rib. Such single circumferentially extending rib is preferably adjacent one end face of the roll.

The novel features which are considered as characteristic of the invention are set forth in particular in the appended claims. The improved method itself, however, together with the features and advantages of the improved tool and grinding wheel, will be best understood upon perusal of the following detailed description of certain specific embodiments with reference to the accompanying drawing.

DESCRIPTION OF THE PREFERRED EMBODIMENTS

Figure 1:
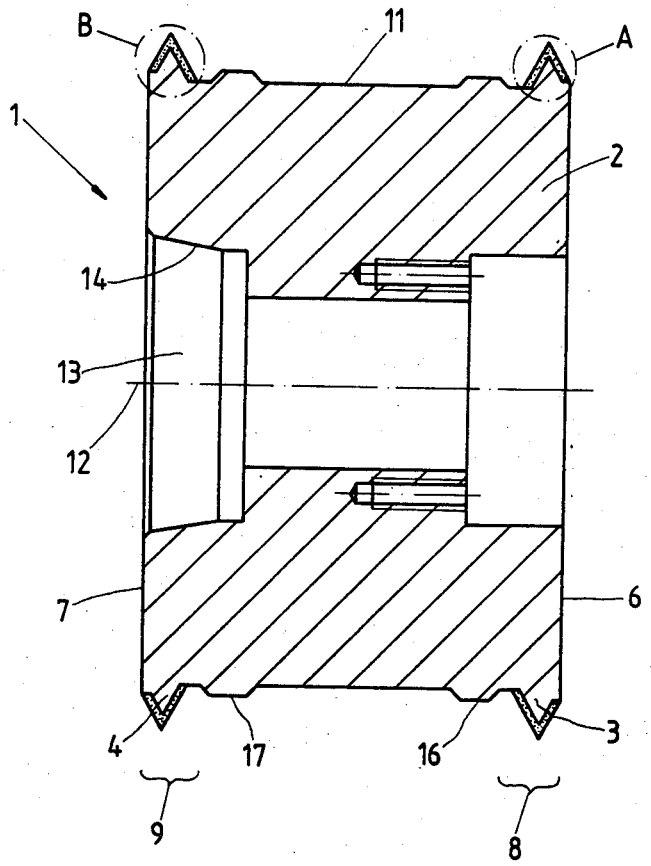
FIG. 1 is an axial sectional view of a tool including a diamond roll which embodies one form of the present invention.
Figure 4:
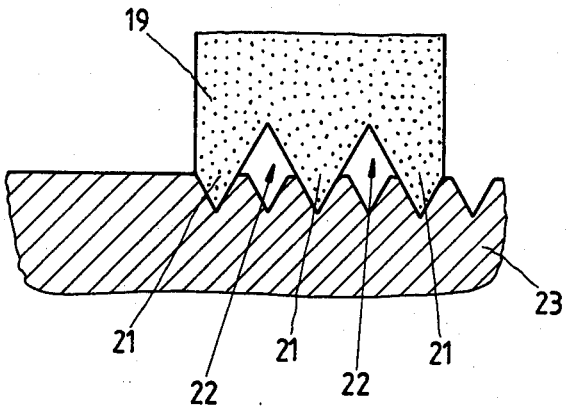
FIG. 4 is a fragmentary axial sectional view of a grinding wheel which embodies the invention, the grinding wheel being in contact with a rotating workpiece.

FIG. 1 shows a diamond roll 2 which forms part of a tool 1 for profiling and dressing a grinding wheel, for example, the grinding wheel 19 of FIG. 4. The illustrated grinding 19 wheel is designed to cut metric threads. For example, the tool 1 of FIG. 1 can be designed to cut grooves 21 into the peripheries of wheels 19 which can be used to cut threads having diameters in the range of 3–68 mm. The roll 2 has two parallel end faces 6 and 7 and two profiling ribs 3 and 4. The rib 3 is adjacent the end face 6, and the rib 4 is adjacent the end face 7. Those portions of the peripheral surface 11 of the roll 2 from which the ribs 3 and 4 project are respectively denoted by the characters 8 and 9. The tool 1 is mounted on a torque transmitting element which is not shown. For example, such torque transmitting element can constitute a dressing spindle having a relatively short conical external surface which engages with a complementary conical internal surface 14 surrounding an axially extending socket 13 in the end face 7 of the roll 2. The spindle and the roll 2 rotate about a common axis 12.

The rib 3 is disposed between the end face 6 and a cylindrical portion 16 of the peripheral surface 11, and the rib 4 is disposed between the end face 7 and a cylindrical portion 17 of the peripheral surface 11 of the roll 2. The cylindrical portions 16 and 17 can be utilized as control- or reference surfaces to ascertain whether or not the tool 1 is running out of true.

Figure 3:
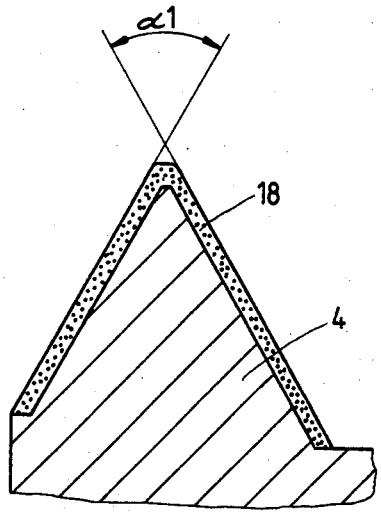
FIG. 3 is an enlarged view of the detail within the phantom-line circle B in FIG. 1.
Figure 2:
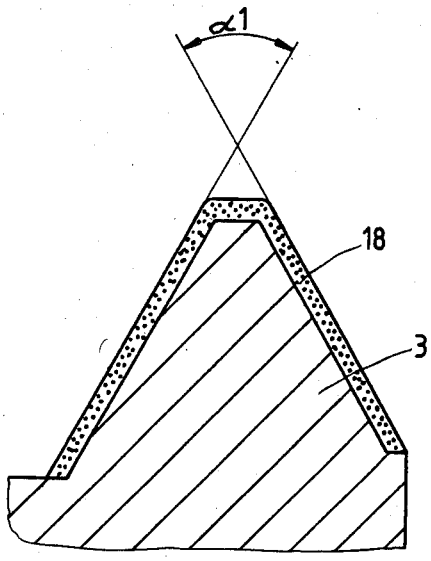
FIG. 2 is an enlarged view of the detail within the phantom-line circle A in FIG. 1.

FIG. 2 shows a portion of the rib 3 which serves for preliminary profiling and dressing of the grinding wheel 19 at its axial ends. The rib 4, the details of which are shown in FIG. 3, serves for final or finish profiling and dressing of the major part of the profile or contour of the grinding wheel 19. The angle $\alpha_1$ between the mutually inclined flanks of the rib 3 or 4 corresponds to the angle $\alpha_2$ between the flanks of the 21 alternating with the grooves 22 of the grinding wheel 19 (see also FIG. 5). The reference characters 18 denote layers of diamonds covering those portions (including the flanks) of the ribs 3 and 4 which come into contact with the grinding wheel 19 in the course of a profiling or dressing operation. For example, the ribs 3 and 4 can be provided with layers of diamonds in a distribution of approximately 50 per $cm^2$.

The roll 2 can be said to constitute a single-rib diamond roll because the rib 3 is idle when the rib 4 is in use and vice versa. Otherwise stated, the roll 2 is a single-rib roll which carries a spare rib 3 or 4. This holds true irrespective of whether the roll 2 is used for profiling or for dressing.

Figure 5:
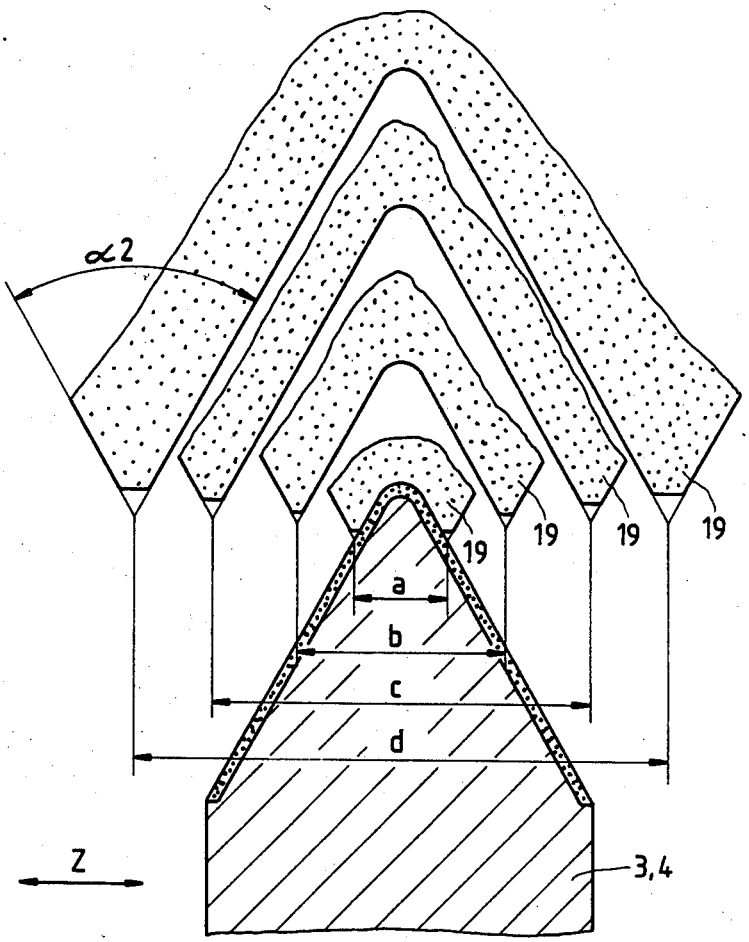
FIG. 5 is a fragmentary schematic axial sectional view of a portion of a novel tool in contact with one of a plurality of grinding wheels which can be dressed and/or profiled thereby.

FIG. 5 shows that one and the same rib 3 or 4 can be used for the profiling or dressing of a wide range of grinding wheels 19 as long as the angle between the flanks of the ribs on the grinding wheel equals the angle $\alpha_2$. The rib 3 or 4 penetrates into the deepmost portion of the groove 22 between two neighboring ribs 21 of the grinding wheel 19 regardless of whether the groove 22 is shallow or deep. FIG. 5 shows four grinding wheels 19 wherein the maximum width of grooves between the tips of neighboring ribs (as measured in the direction of the Z axis) varies from a very small value a to a larger value b, to a still larger value c and to a still larger value d.

In order to profile and dress a grinding wheel 19, the rib 3 or 4 is caused to plunge into the selected portion of the peripheral surface of the grinding wheel, the roll 2 is thereupon retracted in the radial direction of the grinding wheel, the roll is moved in the direction of the Z axis into register with a fresh portion of the periphery of the grinding wheel, the selected rib 3 or 4 is caused to plunge into the adjacent portion of the grinding wheel, the roll 2 is again retracted radially of the grinding wheel, and so forth until the grinding wheel is provided with a selected number of grooves 22. The entire profiling and/or dressing operation can be programmed. The programming is different for each of the grinding wheels having different diameters because it is necessary to accurately control the extent of penetration of the rib 3 or 4 into the material of the grinding wheel. Moreover, individual programming is necessary on the ground that the rib 3 or 4 must cover different distances in the direction of the axis Z.

It is preferred to profile relatively small-diameter grinding wheels (e.g., for the cutting of threads having a diameter of between 3–24 mm) in such a way that one rib 21 of the grinding wheel 19 is left out per pitch of the thread to be cut on a workpiece 23. This can be seen in FIG. 4. Such cutting of threads results in the making of larger grooves 22. The just described mode of profiling the grinding wheel 19 for the cutting of relatively small-diameter threads enhances the accuracy of smaller threads and allows for a more satisfactory cooling of the location where the grinding wheel treats a workpiece. Of course, this necessitates two revolutions of the workpiece 23 per cycle.

In accordance with a presently preferred embodiment of the method of profiling and dressing grinding wheels with the tool 1 of FIG. 1 or with an analogous tool, profiling of the grinding wheel takes place in two stages, namely a first stage of preliminary profiling which involves preliminary profiling of the surfaces bounding successive grooves 22 and a next stage of final profiling of the surfaces bounding successive grooves 22. The mode of making preliminary profiles is the same as during making of final profiles and the dressing. Thus, one can operate with a quasi single-rib profiling and dressing tool, corresponding to a form roll, but without path control. Plunging of the rib 3 or 4 into the material of the grinding wheel 19 exhibits typical characteristics of profile dressing.

It can be said that the steps of the improved method, in conjunction with the utilization of the novel profiling and dressing tool, constitute a combined or hybrid profile and form dressing with the advantage that the depth of peak-to-valley penetration (effective surface finish) is as satisfactory as during profile dressing rather than that which can be achieved with path-controlled dressing by means of a form wheel.

Another advantage of the improved method and of the improved tool is that only a single profiling and dressing tool is necessary for the treatment of a wide range of grinding wheels for the cutting of external threads. The treatment of surfaces of an entire range of grinding of grinding wheels is highly satisfactory all the way from the top lands to the deepmost portions of the grooves 22. The useful life of the improved tool 1 is longer than that of conventional tools because the radius of the rib 3 or 4 can be selected independently of the profile of the threads to be cut.

An important advantage of a grinding wheel which exhibits the features of the grinding wheel shown in FIG. 4 is it can be used with particular advantage for accurate treatment of workpieces having relatively small diameters but is also equally useful in connection with the treatment of large-diameter workpieces. However, when the grinding wheel is used for the treatment of large-diameter workpieces, the distance between the tips of its ribs 21 can match the pitch of the thread to be cut thereby. As mentioned above, the making of relatively large or wide grooves 22 renders it possible to more satisfactorily cool the region where the grinding wheel 19 penetrates into the workpiece 23. Furthermore, and as mentioned above, the treatment of relatively small-diameter workpieces can be carried out with a higher degree of accuracy if the distance between the tips of neighboring ribs 21 equals a multiple of the pitch of the thread on the workpiece to be treated.

Another important advantage of the improved tool is that it can more satisfactorily treat the profile of the grinding wheel in the region of the end faces of the grinding wheel. In other words, the treatment can be such that no traces of ribs remain at the end faces of the grinding wheel.

One of the ribs 3, 4 can be omitted if the tool 1 is to be used for dressing, particularly for intermittent dressing, of a grinding wheel which is already provided with a suitable profile including alternating ribs 21 and grooves 22. For example, the tool 1 of FIG. 1 can be formed only with the rib 4. Such single rib is preferably, or can be, adjacent one end face of the tool.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of profiling and dressing a grinding wheel, for the grinding of external threads with a diamond roll having a profiling rib, comprising the steps of using the rib of the roll to provide the periphery of the wheel with a first groove, withdrawing the rib from the first groove, moving the roll in parallelism with the axis of the wheel, and using the rib to provide the periphery of the wheel with a second groove.

2. The method of claim 1, wherein each of said using steps includes a first stage of preliminary profiling and a second stage of final profiling of the respective portion of the wheel.

* * * * *